United States Patent [19]

Hammes

[11] 4,002,366

[45] Jan. 11, 1977

[54] ACCESSORY SERVING AS LIFE SAVING AID

[76] Inventor: Robert B. Hammes, 132 Knollcrest Drive, Burlington, Wis. 53015

[22] Filed: Nov. 28, 1975

[21] Appl. No.: 636,218

[52] U.S. Cl. ..... 294/26; 30/164.5; 9/14; 30/162

[51] Int. Cl.[2] ..... F25C 5/16

[58] Field of Search ..... 294/26, 61, 126, 1, 294/25, 29; 30/164.5, 164.6, 164.7, 151, 162; 299/24; 175/18; 9/14

[56] References Cited

UNITED STATES PATENTS

| | | | |
|---|---|---|---|
| 1,181,681 | 5/1916 | Nicaud | 30/162 |
| 1,424,221 | 8/1922 | Trumpeter | 30/164.5 |
| 3,130,884 | 4/1964 | Lintz | 30/164.5 |
| 3,752,524 | 8/1973 | Reick, Jr. | 294/25 |

FOREIGN PATENTS OR APPLICATIONS

| | | | |
|---|---|---|---|
| 41,022 | 1/1915 | Sweden | 9/14 |

OTHER PUBLICATIONS

Article in Washington Post, Dec. 1909, p. 3.

*Primary Examiner*—James B. Marbert
*Attorney, Agent, or Firm*—Albert Latta

[57] ABSTRACT

An accessory for serving as an aid for saving the life of an "ice" fisherman, snow mobile operator, or other recreation or sports minded person who ventures onto an ice covered lake, pond or other body of water and breaks through the ice—the accessory being grasped, such as from a jacket pocket, an ice piercing device being grasped, one in each hand, and being successively thrust into piercing engagement with the ice surface to provide a temporary anchor to absorb pulling thrust exerted by the person as he gradually pulls himself onto firm ice in a prone position.

7 Claims, 7 Drawing Figures

ACCESSORY SERVING AS LIFE SAVING AID

BACKGROUND OF INVENTION

1. Field of Invention

Equipment for use as accessory items generally in the field of sports by a person and serving as aids for life saving purposes after breaking through the ice of an ice covered body of water.

2. Description of the Prior Art

No accessory of the general type forming the subject of the invention is known to the applicant when used by one who has broken through the ice on an ice covered body of water for gradually pulling himself or herself out of the water onto firm ice. The prior art discloses devices employed for use in chipping ice into small pieces for use in cooling a beverage for example. Such "ice picks" include one having a pointed pick secured to a transverse handle and having a covering tube retractible relative to a second tube which telescopically receives the first tube. Under spring inducement the pick is automatically withdrawn into the interior of the second tube when not in use. Other types of retractible "ice picks" are disclosed in the prior art and one or more discloses a pick retractible into the interior of a hollow handle which is in substantial axial alignment with the pick and is intended for hand gripping purposes but such devices are structurally different from that of Applicant's and operate differently.

SUMMARY OF THE INVENTION

The invention relates to an accessory normally carried in a jacket side pocket of a person for ready access in functioning to help in saving his life in the event he breaks through the ice. While the device is in a pocket, the relatively sharp ice piercing pick is covered by the retractible guard for preventing damage to the person's clothing.

An object of the invention is to provide a pair of similar ice piercing devices, each having a pick normally covered by a retractible guard when not in use and each including a carrying casing—the two casings being secured relative to each other by a cord having its opposite ends fastened to a respective casing.

Another object of the invention is to provide a life saving device having a pick with its blunt end imbedded in an end wall of a casing the exterior of which forms a hand gripping portion extending in substantially coaxial alignment with the pick.

A further object of the invention is to provide an ice piercing device in which the outer casing has a coaxial pick interiorly thereof and a coaxial guard telescopically mounted on the shank of the pick, said guard having a diametrically enlarged head reciprocably guided within a diametrically enlarged counterbore at the lower end of the casing and said guard having a passage therethrough for reciprocal mounting on the shank of the pick.

A further object of the invention is to provide an ice piercing pick having an outer casing. The casing has an enlarged counterbore with a shouldered terminus and a guard retractible within the counterbore, whereby its lower end is substantially flush with the lower end of the casing to prevent the tendency of snow from packing and deterring spring energized movement of the guard into covering the pointed end of the pick during non-use thereof.

A further object of the invention is to provide a normally guarded ice piercing pick in which the construction is such that the ice piercing pick (per se) is highly resistant to side or lateral thrust relative to the casing which carries the pick, thereby avoiding possible malfunctioning or bending of the pick as it is being forcibly jabbed into the ice covering during life saving efforts and then is subjected to a strong radial pulling force while being temporarily anchored in the ice.

A further object of the invention is to provide an ice piercing pick secured to a carrying casing, with a spring biased guard reciprocable within the casing—the pick including an elongated shank portion closely guiding the retractible guard throughout its full length of travel within a bore in the casing, thereby preventing lateral "play" which would otherwise cause the likelihood of the pick bending relative to the casing when the pick is forcibly jabbed into the solid ice and radial pulling force is applied.

A further object of the invention is to provide an ice piercing pick with a pick covering guard resiliently retractible a limited distance when the pointed end of the pick is in use.

A further object of the invention is to provide a normally guarded ice piercing pick with a minimum of components and ready assembly thereof at a minimum expense.

Other objects and advantages of the invention will become apparent from the following specification and accompanying drawing.

DESCRIPTION OF THE PREFERRED EMBODIMENT

Figure 1:
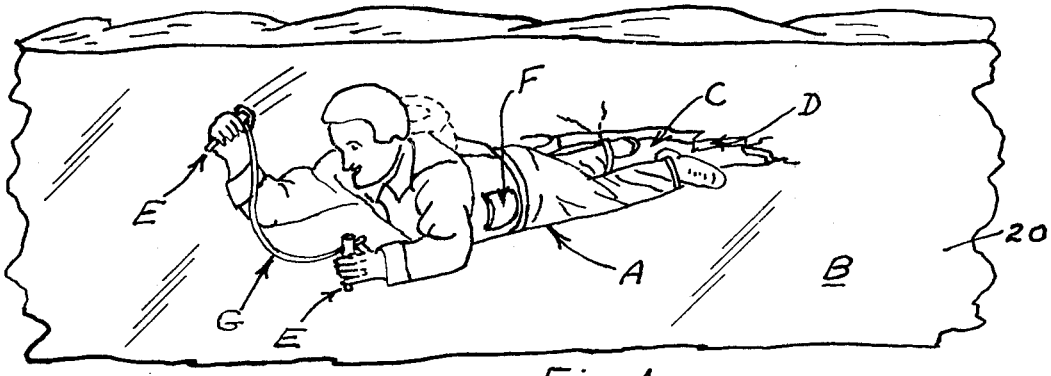
FIG. 1 is a pictorial showing of the invention as employed as an aid in a life saving act.

Referring to FIG. 1 I have shown pictorially a person A lying substantially prone on the surface B of an ice covered body of water C. The person is nearly completed with the task of extracting himself from the opening D in the ice covering by applying hand over hand successive strokes with the ice piercing picks E. Thus he gradually pulls himself away from the opening D a few more inches with each ice piercing stroke of a pick and then manually pulling himself toward the temporarily anchored pick. In the prone position shown in FIG. 1 the weight of the person upon the ice covering adjacent the opening D is distributed over a much larger surface area of such ice covering and hence the ice covering is capable of supporting the person pending further rescue, if necessary.

It will be understood the person was standing upright on the ice covering—a concentrated weight load on such covering—causing the ice covering to break and the person to sink into the water at the opening D. One of his hands can be employed to engage the ice covering adjacent to opening D, preventing total submergence, while the other hand is available to remove the ice piercing devices from his jacket pocket F.

In FIG. 1 I have shown an ice piercing device E in each hand, such devices being tied together by means of an interconnecting rope or cord G of suitable but not excessive length. When such interconnecting cord G is employed, it is possible for such assemblage to be tossed as a unit by one person to another person who has broken through the ice and who has no ice piercing picks on him. It is also possible to quickly remove the assemblage "unitarily" by grasping any portion thereof—the cord only, one ice piercing device only etcetera, and giving a "pull ". It is preferable that the cord G and the picks E be made of bright colored materials, such as brilliant orange, for rapid visual notice when needed. It will be understood that if the cord G is eliminated, two of the ice piercing devices may be inserted into the jacket pocket and then be removed by the free hand and subsequently grasped by both hands—one in each hand.

Figure 2:
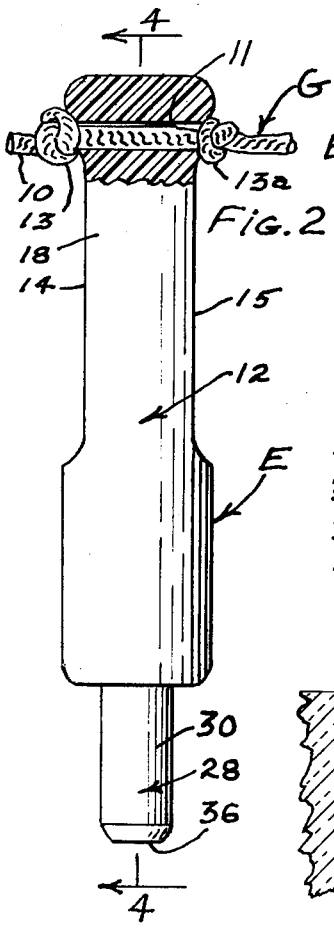
FIG. 2 is a side elevation, partly in section, and showing one device with a fragmentary portion of a cord for interconnecting, if desired, a pair of such devices.

In FIG. 2 I have shown how cord G can be fastened to the upper end of each ice piercing pick by feeding one end 10 (while unknotted) through the passage 11 extending through the outer casing 12 at its upper end. Then knots 13 and 13*a* can be formed for retaining each accessory E at opposite ends of the cord.

On opposite sides of each outer casing 12 I prefer to provide elongated recessed areas 14 and 15 which are helpful for hand gripping of the exterior of the outer casing and which provide flat surfaces for use of lettering or other purposes.

Referring to the remaining figures of the drawing the outer casing 12 is preferably formed of synthetic resin material as an injection molded component—or it may be fabricated of other material if desired. The blunt or upper end 16 of the pick 17 may be imbedded in the upper body portion 18 of the casing at the time of the injection molding process or it can be forcibly pressed into an elongated axial passage previously formed in the casing. In either event a substantial portion of the upper end of the pick is provided with a heavy knurled outer surface (as indicated at 16) so that the pick is firmly anchored to the casing. The pick may be formed of steel or other suitable rigid and strong material so that the pointed end 19 does not bend or otherwise become damaged when jabbed repeatedly into the ice 20.

The interior of the casing is provided with an axial cylindrical bore 21 providing an annular shoulder 22 against which the upper end of compression spring 23 abuts. Bore 21 opens into diametrically enlarged cylindrical counterbore 24 and the lower end of the casing is provided with a still further diametrically enlarged cylindrical counterbore 25 providing annular shoulder 26 against which the annular bushing 27 abuts.

The protective guard 28 is preferably a molding formed of synthetic resin material and is provided with a cylindrical enlarged head 29 formed at the upper end of the cylindrical shank or sheath portion 30 which is reciprocably received in the central circular opening 31 of bushing 27. The head 29 is reciprocable in and guided by the interior cylindrical wall of casing bore 24. An axial cylindrical passage 32 extends through guard 28 and the guard is thus reciprocably mounted on the pick 17 and guided thereby.

The compression spring 23 encircles the pick 17 and its lower end abuts the upper end surface 33 of the guard head 29. The spring and guard are positioned onto the pick 17 within casing bore 24 before the bushing 27 is firmly secured within casing counterbore 25 as by means of a suitable adhesive or alternately by means of a press fit.

When the accessory E is not in use (as shown best in FIGS. 2 and 4), the spring is still partially compressed and the annular underneath shoulder 34 of the guard head is held against the upper annular surface 35 of the bushing 27, in which position the lower end of the pick (including the pointed end portion 19) is covered by the guard 28. Thus the accessory E can be kept in a jacket pocket without clothing damage to the wearer by the pointed end of the pick. Additionally, it is desirable not to make the point 19 on the pick too sharp, such as to cause possible injury to the user. Thus, the point is blunted slightly but not such as to impair its ice piercing qualities.

Figure 3:
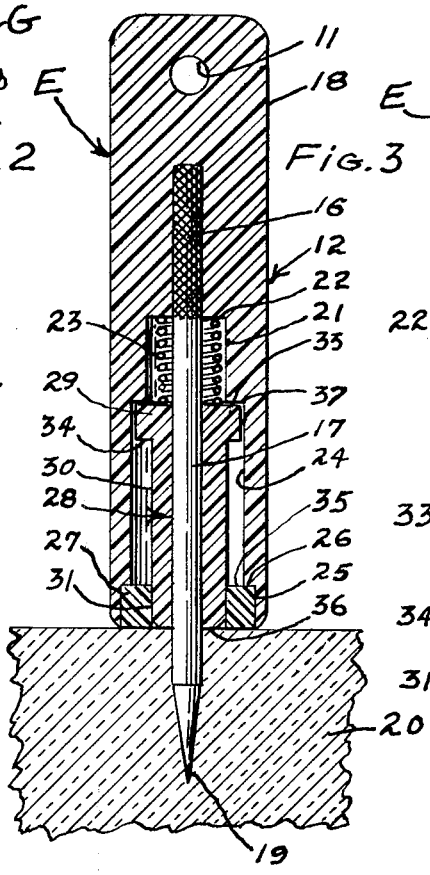
FIG. 3 is a side elevational sectional view of the device of FIG. 2, rotated 90°, and with the ice piercing portion of the pick driven into a layer of ice to maximum piercing distance.

When the pick is forcefully jabbed into the ice as shown in FIGS. 1 and 3, the chamfered or slightly rounded lowermost nose portion 36 of the guard engages the ice 20 and immediately the guard retracts upwardly in casing bore 24 against the tension of spring 23, the distance of travel of the guard being limited by the annular shoulder 37 formed at the upper end of bore 24. When the pick has been jabbed into the ice to the maximum possible depth, then the underneath and lowermost surfaces of casing, bushing and guard are substantially flush with each other (as shown in FIG. 3) and there is little likelihood of any snow (which may be on the surface of the ice) packing and clogging the underside of the accessory E, such as to cause the guard to become jammed in the retracted position shown in FIG. 3. It is very important that the pick not be subjected to lateral bending relative to the axis of its carrying casing 12 during the forceful jabbing of the pointed end 19 into the solid ice and the subsequent radial pulling on the pick as a temporary anchor. Resistance to such bending is assured by providing a relatively close, but sliding fit of the cylindrical elongated shank portion of the pick within the internal bore 32 of the guard 28 together with the close, but sliding fit of the outer cylindrical wall 30 of the guard within the bushing opening 31 together with the close, but sliding fit of the guard head 29 within the casing bore 24. It will be understood that during the jabbing stroke appreciable lateral thrust is imposed on the pointed end 19 as well as the vertical thrust. After the pointed end is jabbed into the ice, then extensive lateral force is imposed on the pick as the person using the pick pulls hinself toward the pick in an almost totally radial direction (which is largely predominant during the jabbing stroke).

The extent of resistance offered by the spring 23 when substantially fully compressed is relatively light so that the retraction of the guard during ice jabbing is rather easily effected.

Figure 4:
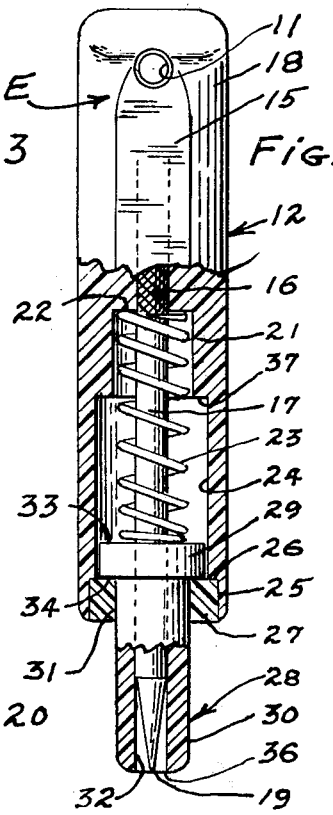
FIG. 4 is a side elevational view taken on the line 4—4 of FIG. 2 with parts being shown in section.
Figure 6:
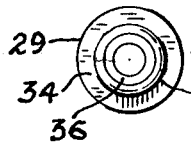
FIG. 6 is a detail underneath view of the guard of FIG. 5.
Figure 7:
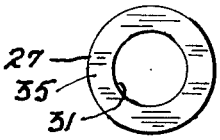
FIG. 7 is a detail plan view of the guard retaining bushing.
Figure 5:
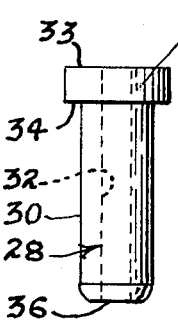
FIG. 5 is a detail side elevational view of the pick guard.

The length and circumference of the accessory E is preferably about as shown in FIGS. 2, 3 and 4 and it can be seen that the outer surface of the casing thus can be firmly gripped by the fingers and palm of a human hand as indicated in FIG. 1. If desired, additional gripping action could be afforded by forming serrations in the exterior surface of the casing, particularly in the lower end of the casing beneath the recessed areas 14 and 15.

I claim:

1. An ice piercing device comprising a substantially vertically directed outer casing forming a hand gripping handle; a pick having its upper end secure with the casing and internally thereof; said casing having a first bore therein; a second bore diametrically greater than the first bore; a pick guard positioned in the second bore for reciprocation therein; said guard having a passage extending therethrough and being reciprocably mounted on the pick; a shoulder formed on the casing at the upper end of the first bore; a spring encircling the pick and interposed between the shoulder and the guard for normally urging the guard downwardly; means within the casing for limiting the downward travel of the guard; said pick having an ice piercing pointed nose at its lower end.

2. An ice piercing device as set forth in claim 1 wherein the guard includes a sheath portion and a head portion diametrically enlarged from the sheath portion and located at the upper end of said sheath portion, the lower end of the spring engaging the guard head portion; a second shoulder formed in the casing at the upper end of the second bore and serving to limit the upward travel of the guard.

3. An ice piercing device as set forth in claim 2 wherein the means for limiting the downward travel of the guard includes a separate bushing secured to and within the casing at the lower end of the second bore, said bushing having a central opening therethrough for closely receiving and guiding the sheath portion of the guard reciprocably.

4. An ice piercing device as set forth in claim 3 wherein a third shoulder is formed in the casing at the lower end of the second bore and the upper surface of the bushing seats against such shoulder.

5. An ice piercing device as set forth in claim 2 wherein the maximum distance of axial travel of the guard relative to the outer casing is less than 50% of the over all length of the outer casing.

6. An ice piercing device as set forth in claim 5 wherein the lower end of the spring abuts and engages the upper end wall of the guard head portion and the wall forming the passage in the guard is closely fitted relative to the outer wall of the pick so as to reciprocably accomodate the pick in substantially the same close fit throughout the full length of the guard relative to the pick.

7. An ice piercing device as set forth in claim 6 wherein the diameter of the pick relative to the inside diameter of the guard passage is substantially constant throughout the full length of travel of the guard relative to the pick.

* * * * *